US005655958A

United States Patent [19]

Lupi

[11] Patent Number: 5,655,958

[45] Date of Patent: Aug. 12, 1997

[54] ELASTIC BASE GRINDING WHEEL FOR SMOOTHING AND POLISHING TOROIDAL CONTOURS OF HARD MATERIALS

[76] Inventor: Quintilio Lupi, Via Flaminia, 138, Rome, Italy, 00068

[21] Appl. No.: 617,903

[22] PCT Filed: Sep. 20, 1994

[86] PCT No.: PCT/IT94/00152

§ 371 Date: May 24, 1996

§ 102(e) Date: May 24, 1996

[87] PCT Pub. No.: WO95/08418

PCT Pub. Date: Mar. 30, 1995

[30] Foreign Application Priority Data

Sep. 24, 1993 [IT] Italy ..... RM930169 U

[51] Int. Cl.[6] ..... B24B 41/00

[52] U.S. Cl. ..... 451/342; 451/504; 451/541; 451/544

[58] Field of Search ..... 457/342, 530, 457/540, 541, 544, 504, 543, 913; 125/11.01, 11.03; 57/293, 298, 299; 451/342, 504, 540, 541, 544, 44, 443

[56] References Cited

U.S. PATENT DOCUMENTS

| | | | |
|---|---|---|---|
| 809,420 | 1/1906 | Berry | 451/540 |
| 925,546 | 6/1909 | Williams | 451/544 |
| 3,204,371 | 9/1965 | Booth . | |
| 3,364,630 | 1/1968 | Rusk et al. | 451/504 |
| 3,528,203 | 9/1970 | Franklin et al. | 451/342 |
| 3,698,141 | 10/1972 | Landmark et al. | 451/504 |
| 3,882,996 | 5/1975 | Waller | 451/504 |
| 5,020,282 | 6/1991 | Okajima et al. | 451/541 |

FOREIGN PATENT DOCUMENTS

| | | | |
|---|---|---|---|
| 0281050 | 9/1988 | European Pat. Off. . | |
| 0476272 | 3/1992 | European Pat. Off. . | |
| 860043 | 1/1941 | France | 451/342 |
| 182604 | 3/1907 | Germany . | |
| 3403605 | 8/1985 | Germany | 451/540 |

*Primary Examiner*—Robert A. Rose
*Assistant Examiner*—George Nguyen
*Attorney, Agent, or Firm*—Watson Cole Stevens Davis, P.L.L.C.

[57] ABSTRACT

The elastic base grinding wheel for the smoothing and polishing of toroidal contours of hard material comprises a rigid-material support body, which may also be divided into two parts along an equatorial plane in a substantially centered position, has an internal shape suitable for mating operatively with the motor shaft with which it is coupled, and an external shape congruent with that of the contour of the material to be smoothed or polished. At least, a wing at or the end of the support body, is arranged for receiving and holding a coating of elastomeric material injected or vulcanized in situ. The part of the injected coating of elastomeric material directed towards the workpiece is coated with elements of relatively flexible abrasive material, so that the overall contour corresponds to the final shape that must have the workpiece after the smoothing or polishing.

12 Claims, 2 Drawing Sheets

ELASTIC BASE GRINDING WHEEL FOR SMOOTHING AND POLISHING TOROIDAL CONTOURS OF HARD MATERIALS

BACKGROUND OF THE INVENTION

The present invention relates to an elastic-base grinding wheel for smoothing and polishing toroidal contours of hard materials.

In the art of working of hard materials, and in particular of marble finishing and polishing, grinding wheels are used to operate on the previously worked part.

The known grinding wheels are generally made of magnesite, resinous materials or the like, and in any case, they are made of rigid materials and, as a consequence, serious problems are encountered owing to variations of the thickness of marble slabs, granite or stone to be machined because since the grinding wheels known in the art are rigid, they cannot correctly match and adhere and consequently operate on the whole surface of the various contours encountered. Also, grinding wheels made out of a vulcanized rubber body are known, provided with cemented diamond-coated cloth suitable for smoothing and polishing, but this kind of construction shows both the problem of an excessive cost of the vulcanized rubber body and the problem of having a non uniform compliance since the areas where the rubber thickness is smaller, owing to their excessive flexibility, do not adhere adequately to the contour to be machined.

In practice, in grinding operation and subsequent finishing operations up to polishing or honing of rigid and hard materials such as glass, marble, granite and the like, two kinds of techniques have been developed.

The first kind entails the use of very rigid shaped bodies for grinding, finishing and polishing. The machining bodies having high rigidity are mainly utilized in extreme precision operations such as optical pieces or high-precision mechanical parts. The working operations with rigid bodies, even if they provide excellent results insofar as the dimensional tolerances are concerned, are however very slow: the optical polishing for e.g. large dimensions telescope mirrors may last for months or even years.

The second kind entails the use of either flexible or deformable shaping bodies made of felt, rubber or the like. The flexible bodies do not allow a precise working, but however allow to perform the working in extremely short times. These short working times are bound to the skill of the operator and show difficulties in working shaped bodies such as those having a toroidal contour.

As a matter of fact in working a hard material that can be polished, abrasives having a decreasing grain size are used with the progress of the finishing operations. When grinding and polishing bodies are used, which incorporate the abrasive materials, if the shaping bodies are either flexible or elastic, it is difficult to obtain a correct matching in the subsequent passes with grinding bodies including abrasives having a decreasing grain size.

EP-A-0 281 050 discloses an abrasive grinding wheel for working stone materials comprising a supporting body associable with a rotating operating assembly. According to the invention the grinding wheel comprises an elastically resilient mass peripherally defining a region with a shape substantially complementary to the shape of the part being machined. Portion in abrasive material are provided on said region.

SUMMARY OF THE INVENTION

The aim of the present invention is to provide a smoothing and polishing tool for hard materials in particular with toroidal shapes or the like that allows to combine the advantages of the two techniques above mentioned allowing to perform precision working characteristic of rigid shaping bodies and the speed of operation typical of elastic or flexible shaping bodies.

According to the present invention, an elastic base grinding-wheel for the smoothing and polishing of toroidal contours of hard materials, that comprises a rigid-material support body, having an internal shape suitable for mating operatively with the motor shaft with which it is coupled, and having an external shape congruent with that of the contour of the material to be smoothed and/or polished; at least a wing at one and/or the other end of the support body, arranged for receiving and holding a coating of elastomeric material injected or vulcanized in situ; the part of the injected elastomeric coating directed towards the workpiece being coated with elements of relatively flexible abrasive material, so that the overall contour corresponds to the final shape that must have the workpiece after the smoothing and/or polishing, characterized in that the support body is divided along an equatorial plane in a position substantially centered between the wings, the division being arranged so that the two body parts do not have undercuts and between which, at the moment of the assembly thereof, and before the elastomeric coating has been injected, can possibly be inserted spacers for modifying the final contour of the grinding wheel in order to satisfy different operational requirements.

In this last embodiment, there results the advantage consisting in the fact that the single parts that will constitute the support body may be realised without undercuts, allowing to obtain the single pieces by injection moulding of thermoplastic material with low-cost moulds, as it will be clear to a person skilled in the art.

The present invention will be now disclosed with reference to embodiments thereof presently preferred, referred to only as a non limiting example, and according to the figures of the attached drawings wherein:

DETAILED DESCRIPTION OF THE INVENTION

It is stressed that the shaping of the part performing the abrading action, as represented in the figures, is given only as a non limiting example, because the present invention is directed to the structure of the grinding wheel, independently from the specific contour herein disclosed referred to for ease of discussion.

Figure 1:
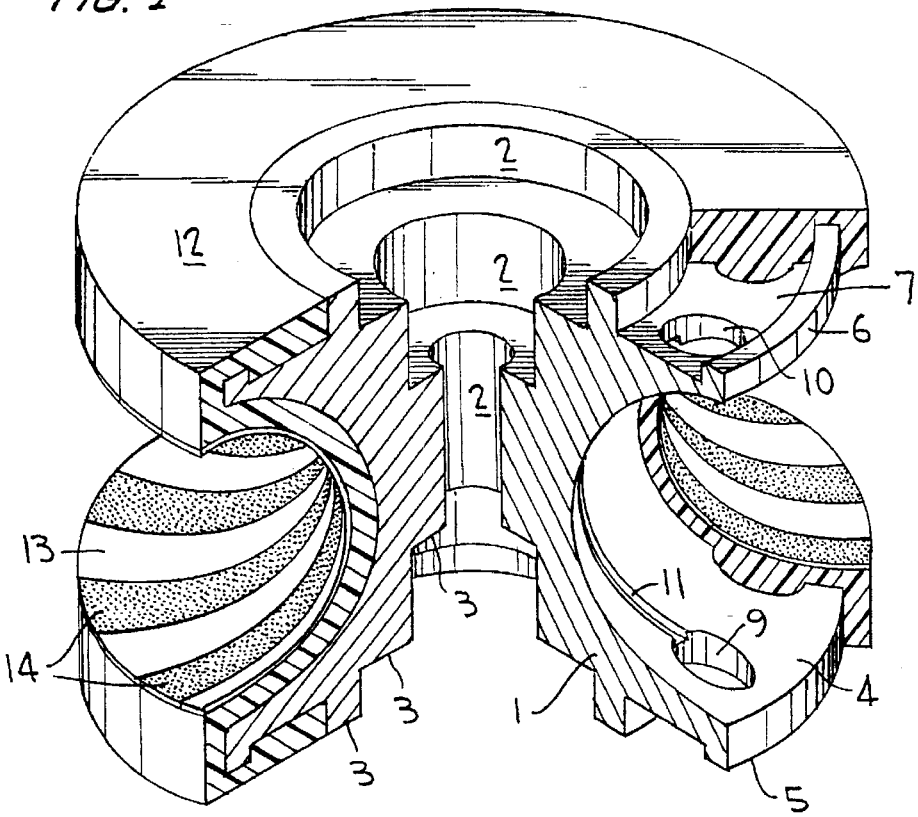
FIG. 1 shows a first embodiment of the grinding wheel according to the invention, partially broken and partially cut away.

With reference to FIG. 1, the grinding wheel comprises a body 1 of a rigid material such as aluminum PVC, or the like, having an internal shaping generally shown in 2 and 3, arranged for mating in a known way will a motor driven spindle with means not shown.

The body 1, on its external part, has a contoured part 4, matching the contour to be worked and a pair of wings 5 and 6. It is to be remarked that with some contours to be machined only one of the wings 5 or 6 may be provided.

The wings 5 and 6 have circumferential channels 7, 8 and holes 9, 10, distributed along the channels 7, 8. The holes 9 and 10 are arranged in a corresponding way to be radiused with grooves 11 in the contoured part 4.

As it can more dearly seen in the left part of the figure, on the body 1 there is realised a coating 12 of an elastomeric material, preferably locally injected or vulcanized, having a hardness Shore B between 50 and 70, and preferably between 58 and 64.

The channels 7 and 8, the holes 9 and 10, as well as the grooves 11 have the purpose of holding firmly the coating 12 of elastomeric material also in the presence of the very high stresses due both to the centrifugal force and to the torque.

It is remarked that normally these kinds of grinding wheels run at a speed of about 6000 r.p.m.

On the part 13 of the coating 12 facing the work piece there are fastened, preferably by thermal welding, strip shaped abrasive elements 14, having a certain flexibility, of a kind known in the art.

The operation techniques of the above disclosed grinding wheel are known to a person skilled in the art and therefore will not be discussed into detail.

It is to be noted that the structure of the grinding wheel according to the invention is such so as to limit an excessive expansion of the elastomeric element caused by the centrifugal force that would lead to a modification of the intended contour. Moreover, the body of the grinding wheel is such to accommodate the entire surface of the contour of the workpiece, that had been shaped in advance.

It is stressed again that the particular shaping of the working contour that has been shown is referred to only as a non limiting example and that such contour, jointly will the shaping of the rigid body 1 and the number of wings 5 and 6, may change according to specific requirements, while retaining the technical teaching of the locking structure of the coating of elastomeric material.

Figure 2:
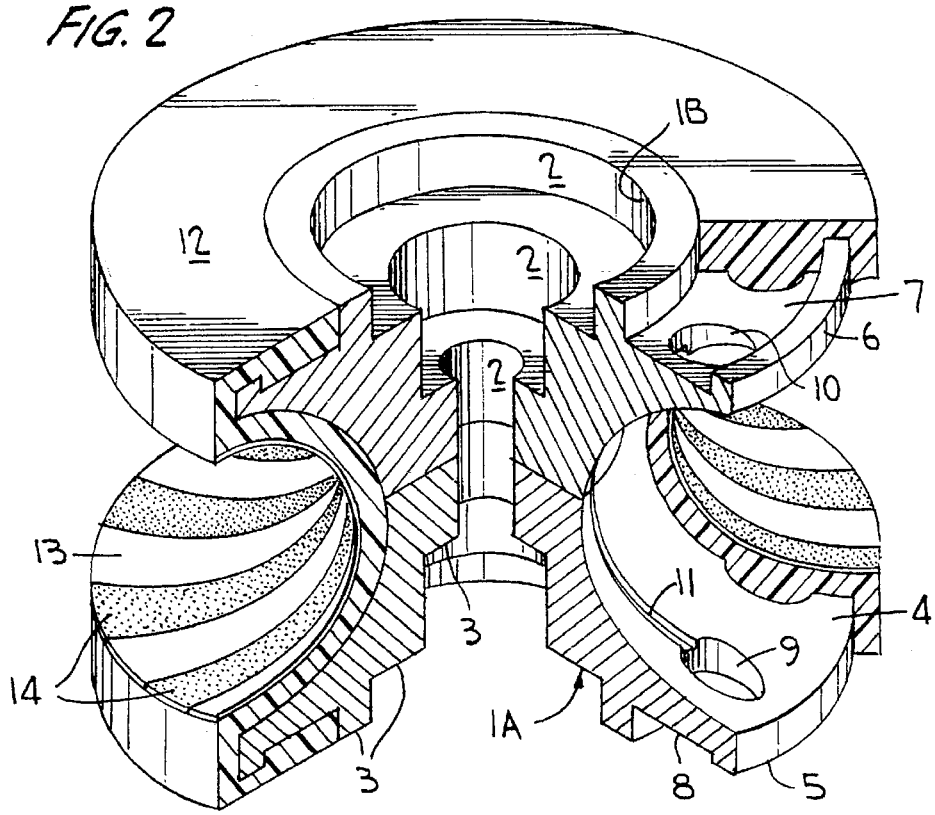
FIG. 2 shows a second embodiment of the grinding wheel according to the invention, partially cut-away and partially broken.

With reference to FIG. 2, there is shown a grinding wheel similar to that of FIG. 1, with the difference that the center body is divided along its equator in two separate parts that are however coupled together and shown in 1A and 1B. Such arrangement may be better seen in FIG. 3. With this construction, the body parts 1A and 1B may be realized in thermoplastic material, such as Nylon, with simple injection moulding techniques since the bodies 1A and 1B do not have undercuts that would render complex and costly the moulds.

If it is desired that the bodies 1A and 1B be made of metal, these could be easily produced by die-casting of aluminium alloys or the equivalent and the dies may be of simple construction.

Figure 3:
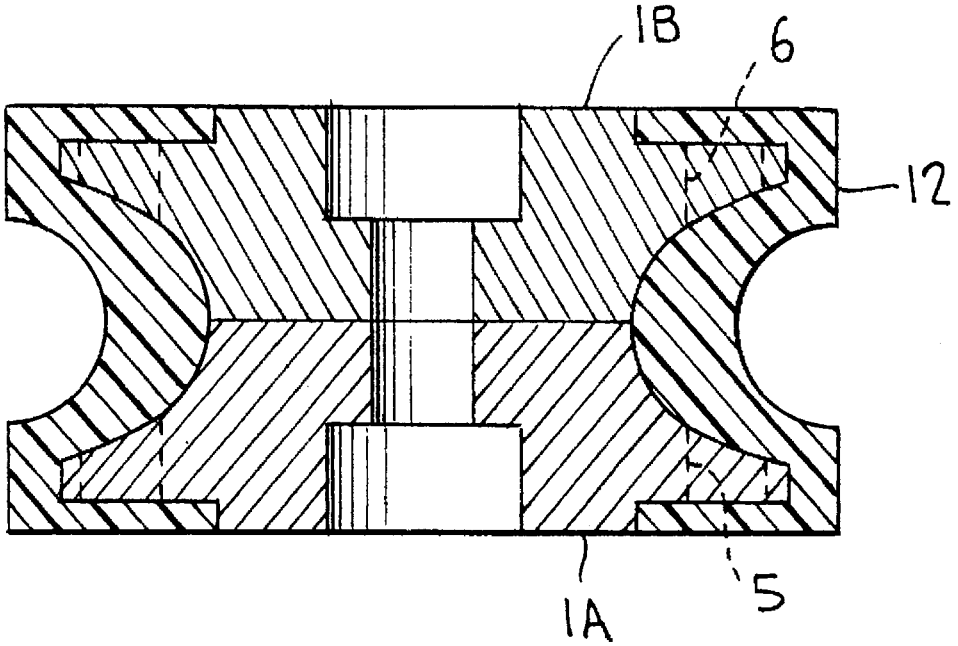
FIG. 3 shows a sectional view along a diameter of the grinding wheel shown in FIG. 2.

In FIG. 3 there is shown a modification of what has been illustrated in FIGS. 2 and 3. Between the bodies 1A and 1B there are inserted spacers 20, 21, of annular shape that are embedded into the injected body 12' of elastomeric material.

In this way different shapes of the external contour of the injected body 12' may be obtained in order to satisfy different requirements in the operation of the grinding wheel.

Figure 4:
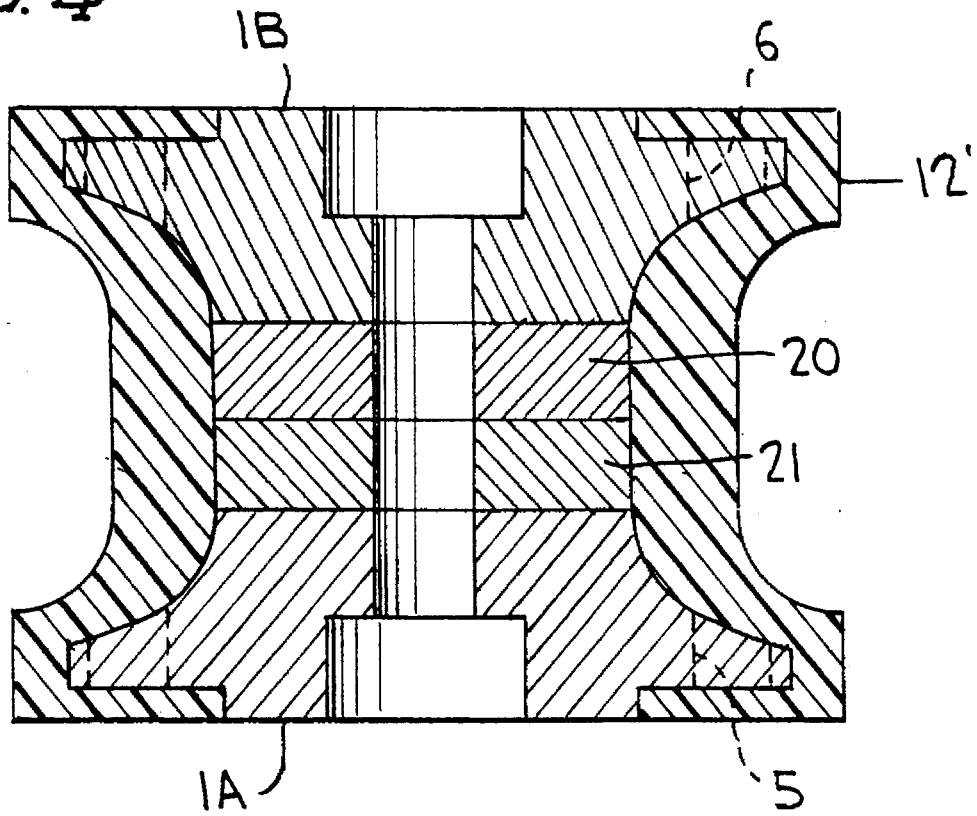
FIG. 4 shows a modification of the structure shown in FIG. 3.

In FIG. 4, the spacers 20, 21 are shown as annular rings with a cylindrical wall, with a circumference that corresponds to the throat part of the bodies 1A and 1B. Clearly this is a simplification, but it is naturally conceivable that the spacers may assume different shapes for realizing different contours of the injected body 12+.

By means of the splitting of the bodies 1A and 1B, and the possible use of the spacers 20, 21, one can realise grinding wheels with different contours of the injected body 12' for different kinds of working operations, reducing the number of base components, reducing consequently the inventory costs and also the production costs.

The body 1, 1A, 1B of the grinding wheel is preferably realized in thermoplastic materials known under the name Kemiton, commercially available from FRAMPLAST S.p.A., moulded with an injection moulding machine, or with other thermoplastic materials, such as Franprene, Neoprene, Santoprene, all commercially available from MONSANTO S.p.A.

The hardness may range between 65 and 75 Shore, according to the diameter of the grinding wheel to be moulded. For instance for grinding wheels having a diameter of 110/120 millimeters, it is preferable to use a hardness of 65 Shore; for a diameter of 130 millimeters a hardness of 70 Shore is preferable, and for diameters of 140/160 millimeters a hardness of 75 shore is preferable.

As a matter of fact, with the increase of the diameter, the peripheral speed increases and consequently the centrifugal force increases, compromising the mechanical strength. Therefore, this problem has been solved by increasing the hardness concurrently with the increase of the grinding wheel diameter.

Now the technique for fastening the strip abrasive elements shown in 14 and constituted of diamond-coated, commercially available from SORMA, cloth, will be disclosed.

From test that have been performed, it has been found that the diamond-coated cloth members cannot be simply glued because they would not withstand the stresses caused by the centrifugal force and the impacts with the stone, particularly in difficult areas, such as corners and the like.

Consequently it has been necessary to rely on chemical welding, and it has been found convenient a chemical welding performed with the product commercially known as Loctite 401, commercially available from LOCTITE ITALIA, i.e. an adhesive of the class of cyanoacrylates.

The process consists in cutting the cloth in strips not wider than 6–7 millimeters in order to allow the matching with the coating 12 of the grinding wheel; to apply a small quantity of the Lactate, commercially available from LOCTITE ITALIA, adhesive on the cloth, to press the cloth onto the coating 12 for a few moments up to the complete bonding of the two bodies.

A final step, having a great importance, is the filling of the exposed areas 13 between the cloth strips, as well as the filling of all the spaces between each abrasive dot in the diamond coated side of the cloth.

Such coating has two purposes of paramount importance:

1) to eliminate the danger of "hook-up" to the corners of the material being worked;
2) to avoid smears or streaks, i.e. the small grooves that would derive from the dot pattern of the abrasive. Between the dots there are empty spaces in bands that cause such smears or streaks in the material being worked.

Such filling is performed with a cement HARD-PVC, commercially available from VULLJN BISON MASTIC, with added a percentage from 20 to 30% of tin oxide, and from 4 to 8% of diamond powder.

In this way a use duration ranging from 3 to 5 times more with respect to the systems used on the market may be assured.

I claim:

1. An elastic base grinding-wheel for the smoothing and polishing of toroidal contours of hard materials, comprising:

a rigid-material support body having an internal shape suitable for mating operatively with the motor shaft with which it is coupled and holding a coating of elastomeric material injected or vulcanized in situ, wherein a part of the injected elastomeric coating directed towards the workpiece is coated with elements of relatively flexible abrasive material, so that the overall contour corresponds to the final shape that must have the workpiece after the smoothing or polishing, and wherein the grinding wheel has a support having an external shape congruent with that of the contour of the material to be smoothed or polished and having at least a wing at one or the other end of the support body arranged for receiving and holding the coating of elastomeric material, and in that the support body is divided along an equatorial plane in a position substantially centered between the wings, the division being arranged so that the two body parts do not have undercuts.

2. The grinding wheel according to claim 1, wherein the parts constituting the support body are obtained by light-metal die-casting.

3. The grinding wheel according to claim 1, wherein the parts constituting the support body are formed of injection-moulded thermoplastic resin.

4. The grinding wheel according to claim 3, wherein the thermoplastic resin is Nylon.

5. An elastic base grinding-wheel for the smoothing and polishing of toroidal contours of hard materials, comprising:

a rigid-material support body having ah internal shape suitable for mating operatively with the motor shaft with which it is coupled and holding a coating of elastomeric material injected or vulcanized in situ, wherein a part of the injected elastomeric coating directed towards the workpiece is coated with elements of relatively flexible abrasive material, so that the overall contour corresponds to the final shape that must have the workpiece after the smoothing and/or polishing, wherein the grinding wheel has a support having an external shape congruent with that of the contour of the material to be smoothed or polished and having at least a wing at one or the other end of the support body arranged for receiving and holding the coating of elastomeric material, and in that the support body is divided along an equatorial plane in a position substantially centered between the wings, the division being arranged so that the two body parts do not have undercuts, and wherein in correspondence with the division on an equatorial plane of the body, there are arranged one or more spacer elements.

6. The grinding wheel according to claim 5, wherein said one or more spacer elements on the equatorial plane are formed and shaped to constitute an adapter base for the coating of elastomeric material in order to provide an external contour of the grinding wheel congruent with the contour of the material being worked.

7. An elastic base grinding-wheel for the smoothing and polishing of toroidal contours of hard materials, comprising:

a rigid-material support body having an internal shape suitable for mating operatively with the motor shaft with which it is coupled and holding a coating of elastomeric material injected or vulcanized in situ; and a locking means having an opening, a channel, and a groove provided within said support body to minimize the deformation of the injected elastomeric coating, wherein a part of the injected elastomeric coating directed towards the workpiece is coated with elements of relatively flexible abrasive material, so that the overall contour corresponds to the final shape that must have the workpiece after the smoothing or polishing, and wherein the grinding wheel has a support having an external shape congruent with that of the contour of the material to be smoothed or polished and having at least a wing at one or the other end of the support body arranged for receiving and holding the coating of elastomeric material, and in that the support body is divided along an equatorial plane in a position substantially centered between the wings, the division being arranged so that the two body parts do not have undercuts.

8. The grinding wheel according to claim 7, wherein the parts constituting the support body are obtained by light-metal die-casting.

9. The grinding wheel according to claim 7, wherein the parts constituting the support body are formed of injection-moulded thermoplastic resin.

10. The grinding wheel according to claim 9, wherein the thermoplastic resin is Nylon.

11. The grinding wheel according to claim 7, wherein in correspondence with the division on an equatorial plane of the body, there are arranged one or more spacer elements.

12. The grinding wheel according to claim 11, wherein said one or more spacer elements on the equatorial plane are formed and shaped to constitute an adapter, base for the coating of elastomeric material in order to provide an external contour off the grinding wheel congruent with the contour of the material being worked.

* * * * *